US008668480B2

(12) United States Patent
Dennis et al.

(10) Patent No.: US 8,668,480 B2
(45) Date of Patent: Mar. 11, 2014

(54) PRE-PRESSURIZATION PUMP LINER FOR VANE PUMP

(75) Inventors: Paul G. Dennis, Roscoe, IL (US); Timothy J. Franckowiak, Rockford, IL (US); David W. Borgetti, Belvidere, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 368 days.

(21) Appl. No.: 12/887,677

(22) Filed: Sep. 22, 2010

(65) Prior Publication Data

US 2012/0070327 A1 Mar. 22, 2012

(51) Int. Cl.
*F01C 21/10* (2006.01)
*F01C 1/00* (2006.01)

(52) U.S. Cl.
USPC ..... 418/150; 418/260; 418/266

(58) Field of Classification Search
USPC ..... 29/888.025; 418/150, 180, 15, 181, 418/270, 255–260, 266–268
See application file for complete search history.

(56) References Cited

U.S. PATENT DOCUMENTS 2,639,855 A * 5/1953 Daniels ..... 418/15
3,027,719 A 4/1962 Keech
3,150,646 A * 9/1964 Bernard ..... 123/213
3,740,954 A 6/1973 Young
4,109,466 A 8/1978 Keech
4,646,521 A 3/1987 Snyder
5,243,822 A 9/1993 Vismara
5,431,552 A * 7/1995 Davis et al. ..... 418/150
5,630,318 A 5/1997 Folsom et al.
6,666,015 B2 12/2003 Dyer
6,722,854 B2 4/2004 Forsberg
7,500,829 B2 3/2009 Edwards et al.
7,637,724 B2 12/2009 Cygnor

* cited by examiner

*Primary Examiner* — Thomas Denion
*Assistant Examiner* — Laert Dounis
(74) *Attorney, Agent, or Firm* — Carlson, Gaskey & Olds, PC

(57) ABSTRACT

A vane liner for use in a vane pump has a vane liner body defining an inner bore for providing a cam surface in a vane pump. The cam surface has a suction opening formed through the body at one circumferential extent, and a discharge opening through the body at a distinct circumferential extent. A pre-pressurization opening extends through the body at a location upstream of an upstream end of the discharge opening, but spaced by at least 90 degrees from a downstream end of the suction opening. A vane pump incorporating the above-discussed liner is also claimed. Further, a vane pump is also disclosed and claimed having the spacing from the downstream end of the suction opening at least X degrees wherein X equals 360 divided by N, N being the number of vanes in the vane pump.

3 Claims, 2 Drawing Sheets

PRE-PRESSURIZATION PUMP LINER FOR VANE PUMP

STATEMENT OF GOVERNMENT INTEREST

This invention was made with government support under Contract No. N00019-02-C-3002 awarded by the United States Navy. The Government has certain rights in this invention.

BACKGROUND

This application relates to a liner for a vane pump, wherein a pre-pressurization opening is positioned to eliminate cross-flow between suction and discharge pressure chambers.

Vane pumps are known and typically include a rotor rotating within a liner. A cam surface within the liner is positioned eccentrically relative to a rotational axis of the rotor. Vanes extend radially inwardly and outwardly of the rotor, and in contact with the cam surface. Movement of the vanes along the cam surface causes the vanes to move inwardly and outwardly and move a pump fluid from a suction or inlet to an outlet through pump chambers defined between the vanes.

Thus, when the pump chamber communicates with the discharge window opening, an immediate increase in pressure creates rapid decrease in air volume.

Pre-pressurization has been utilized in the past to provide a "step change" in the overall volume reduction and pressure increase. Pre-pressurization occurs by introducing pressurized fluid into inter vane chambers prior to the chambers communicating with the full discharge window opening. With this, there is a step down to an intermediate volume and increase in pressure.

In the existing art, this pre-pressurization opening communicates with a pump chamber prior to an upstream vane making contact with the cam surface downstream of a suction opening. In this way, the pre-pressurization discharge fluid communicates back toward the suction pressure chamber.

This can result in reduced pumping efficiency.

SUMMARY

A vane liner for use in a vane pump has a vane liner body defining an inner bore for providing a cam surface in a vane pump. The cam surface has a suction opening formed through the body at one circumferential extent, and a discharge opening through the body at a distinct circumferential extent. A pre-pressurization opening extends through the body at a location upstream of an upstream end of the discharge opening, but spaced by at least 90 degrees, from a downstream end of the suction opening. A vane pump incorporating the above-discussed liner is also claimed. Further, a vane pump is also disclosed and claimed having the spacing from the downstream end of the suction opening at least X degrees wherein X equals 360 divided by N, N being the number of vanes in the vane pump.

These and other features of the present invention can be best understood from the following specification and drawings, the following of which is a brief description.

DETAILED DESCRIPTION

Figure 1A:
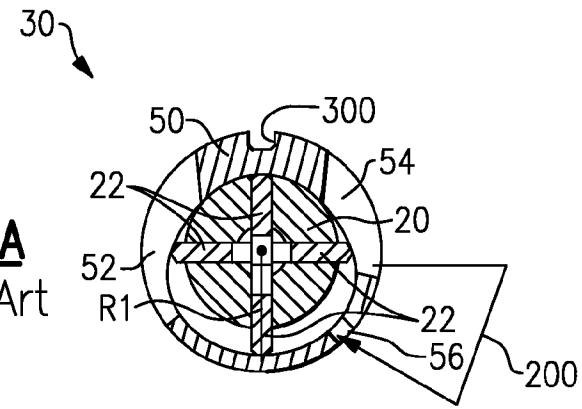
FIG.1A Prior Art
FIG. 1A shows a prior art vane pump.

FIG. 1A shows a prior art vane pump 30. Vane pump 30 includes a rotor 20 and a plurality of vanes 22 that are driven along an inner cam surface on a pump liner 50. The pump liner 50 is provided with a suction opening 52 and a discharge opening 54. As known, the rotor 20 rotates, and the vanes move along the cam surface. Fluid enters pump chambers defined between the vanes 22 through the suction opening 52, and is pressurized and moved toward the discharge opening 54.

As shown at 200, a portion of the discharge pressure fluid can communicate into a pre-pressurization opening 56, and hence into the pump chamber. The pre-pressurization opening 56 can communicate (200) with the discharge pressure fluid downstream of the opening 54 in any number of ways. The opening 56 may communicate with a plenum, or may be provided with a dedicated conduit for delivering the fluid.

Figure 1C:
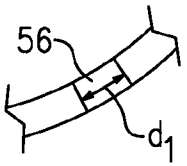
FIG.1C Prior Art
FIG. 1C shows one detail of the FIG. 1A vane pump.
Figure 1B:
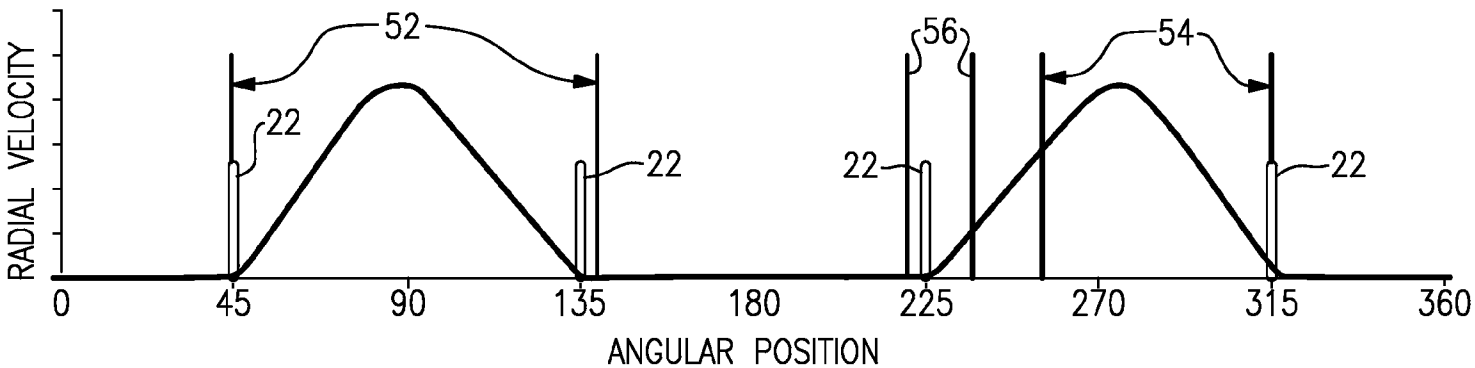
FIG.1B Prior Art
FIG. 1B is a graph of certain aspects of the operation of the FIG. 1A pump.

As shown in FIG. 1B, the vanes 22 are spaced by 90 degrees. The area 52 in the prior art extends over approximately 95 degrees. The opening 56 extends over approximately 13 degrees. The discharge opening 54 extends over approximately 60 degrees.

As can be appreciated from FIG. 1B, the vane 22 at approximately 135 degrees has yet to pass the downstream end of the suction opening 52. At this moment, the vane 22 at approximately 225 degrees has already moved past the beginning of the pre-pressurization opening 56. Thus, there is "cross-flow" or communication between the opening 56 and the suction opening 52. This can result in reduced pumping efficiency.

FIG. 1C shows a detail of the opening 56 which extends for a distance of approximately $d_1$. In this embodiment, $d_1$ is 0.142 inch (0.361 cm). This would be in a vane pump having a nominal radius $R_1$ to the 180 degrees position of the cam surface as shown in FIG. 1A of 0.625 inch (1.588 cm). This $R_1$ would be the major ID cam radius.

The size of the pre-pressurization hole in the prior art has been approximately 1-2 percent of a displacement, with the hole area measured in square inches and displacement in cubic inches. The displacement is calculated as set forth below:

$$\text{Displacement}=[\pi(R-r)(R+r)-N(R-r)t]L$$

Where:

R=Major ID cam radius r=Minor ID cam radius

N=Number of vanes t=thickness of the vanes

L=Length of liner

In the prior art, the R=0.625 inch (1.588 cm), the r=0.425 inch (1.080 cm), there were four vanes, and the vanes were 0.093 inch (0.236 cm) thick. The length L was 1.267 inches (3.218 cm). Thus, utilizing this formula, the diameter $d_1$ of 0.142 inch (0.361 cm) results in a hole area which will be 1-2 percent of the element displacement.

Notably, a diameter of $R_1$: $d_1$ would thus be 4.40.

Figure 2C:
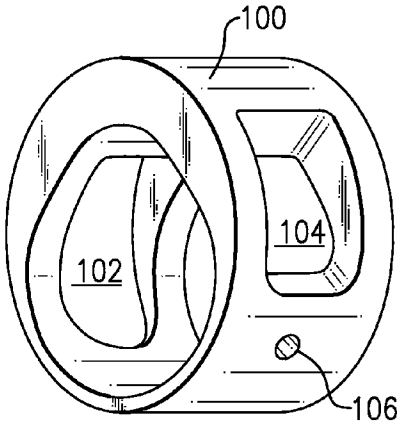
FIG. 2C is a perspective view of the FIG. 2A liner.
Figure 2A:
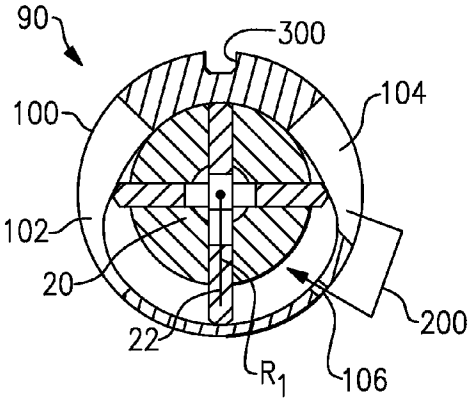
FIG. 2A shows an inventive vane pump.

FIG. 2A shows a vane pump 90 having a liner 100 with a suction opening 102, a discharge opening 104, and a pre-pressurization opening 106.

Figure 2B:
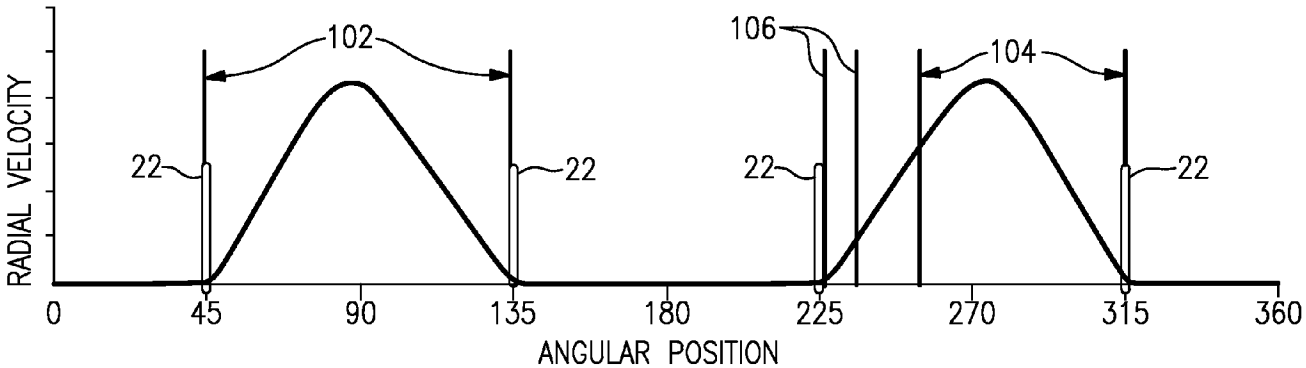
FIG. 2B is a graph showing features of the inventive vane pump.

As can be seen from FIG. 2B, the vanes 22 are still spaced by 90 degrees. The suction opening 102 is approximately 5 degrees smaller than in the FIG. 1A prior art. Thus, it extends over only 90 degrees. The pre-pressurization opening 106 extends over only 9 degrees, and is again smaller than the FIG. 1A pre-pressurization opening 56.

The discharge opening 104 extends from approximately 255 degrees to approximately 315 degrees, and is thus similar to the prior art.

As can be appreciated from FIG. 2B, the vane 22 at 135 degrees will be sealed on the downstream end of the suction opening 102 before the vane 22 at approximately 225 degrees begins opening the pre-pressurization opening 106. Thus, the pre-pressurization opening 106 will not result in cross-flow, and the reduced volumetric efficiency of the prior art will be eliminated.

The pre-pressurization opening 106 is thus shown to be at least 90 degrees from a downstream end of the suction opening, and also upstream from an upstream end of the discharge opening. Further, generally a vane pump has spacing from the downstream end of the suction opening of at least X degrees wherein X equals 360 divided by N, N being the number of vanes in the vane pump. Of course, in the disclosed embodiment, N is 4 and X is 90.

FIG. 2C shows a perspective view of the liner 100. As can be appreciated, the openings 102 and 104 are formed at opposed locations, and the pre-pressurization opening 106 is a relatively small cylindrical hole at an approximately medial axial point.

Figure 2D:
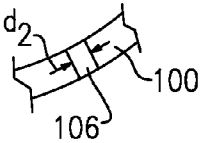
FIG. 2D shows one detail of the FIG. 2A liner.

As shown in FIG. 2D, the pre-pressurization hole 106 extends circumferentially for a distance $d_2$. In one embodiment, the distance $d_2$ is 0.099 inch (0.251 cm). This would be in a liner having a radius $R_1$ to the 180 degrees position of 0.625 inch (1.588 cm). This $R_1$ would be the major ID cam radius.

While angular positions are disclosed in FIG. 2B, it should be understood that any one of these locations can be changed. Further, for purposes of interpreting the claims in this application, the term "approximately" relative to an angular location should be taken as being plus or minus 2 degrees from the listed angular extent.

The quantities for R, r, N, d are all the same as the prior art. However, the L was 0.787 inch (1.999 cm).

Thus, the $d_2$ of 0.099 is calculated. Here, the ratio of $R_1$ to $d_2$ is thus 6.31. This ratio is preferably between 4.0 to 8.0.

Figure 3:
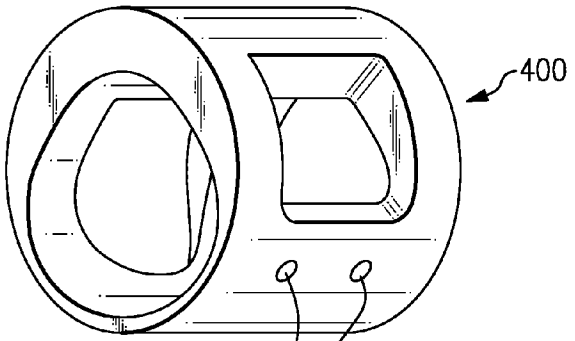
FIG. 3 shows another embodiment.

As shown in FIG. 3, in another embodiment 400, there is a pair of pre-pressurization openings 402. Again, in combination, the area of the openings 402 can be determined by the prior formula.

In a method according to this application, a liner such as shown in FIG. 2C or FIG. 3 is placed within a pump housing in a lubrication system. The pump housing has an inner bore slightly larger than an outer diameter of the liner. A rotor carrying vanes is positioned within the bore of the liner. The notch 300 in the liner of FIG. 1A or 2A is utilized to accept an anti-rotation pin partially seated within a similar notch feature within the pump housing. A portion of the pump housing extends into the notch, and provides anti-rotation. In addition, the notch in the liner may be configured to ensure that the liner is placed within the housing in a proper orientation.

The inventive pump is utilized to move oil. Oil is particularly susceptible to detrimental effects from the inclusion of air, and thus benefits from the present invention. It should be understood that the invention can be utilized for any fluid that has propensity to have inclusion of air.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A vane pump comprising:

a vane liner body defining an inner bore for providing a cam surface, a rotor having a rotational axis and carrying vanes in contact with said cam surface;

said cam surface having a suction opening formed through the body at one circumferential extent, and having a discharge opening through the body at a distinct circumferential extent;

a pre-pressurization opening extending through said body at a location upstream of an upstream end of said discharge opening, but spaced by at least 90 degrees from a downstream end of said suction opening; and a ratio of a cam major radius to a diameter of re-pressurization opening is between 4.0 and 8.0.

2. The vane pump as set forth in claim 1, wherein an upstream end of said suction opening is defined at 45 degrees of rotation, said downstream end of said suction opening being at 135 degrees, and an upstream end of said pre-pressurization opening being at approximately 227 degrees, with a downstream end of said pre-pressurization opening being at 236 degrees, and said discharge opening upstream end is at 255 degrees, and a downstream end of said discharge opening being at 315 degrees, with all of said degree measurements being plus or minus 2 degrees.

3. The vane pump as set forth in claim 2, wherein there are four of said vanes in said rotor.

* * * * *

UNITED STATES PATENT AND TRADEMARK OFFICE

CERTIFICATE OF CORRECTION

PATENT NO. : 8,668,480 B2
APPLICATION NO. : 12/887677
DATED : March 11, 2014
INVENTOR(S) : Dennis et al.

It is certified that error appears in the above-identified patent and that said Letters Patent is hereby corrected as shown below:

IN THE CLAIMS:

Claim 1, column 4, line 35: delete "of re-pressurization opening" and replace with --of the pre-pressurization opening--

Signed and Sealed this
Twenty-seventh Day of May, 2014

Michelle K. Lee

Michelle K. Lee
*Deputy Director of the United States Patent and Trademark Office*